US005426929A

United States Patent [19]

Schwalm et al.

[11] Patent Number: 5,426,929

[45] Date of Patent: Jun. 27, 1995

[54] METHOD AND APPARATUS FOR FORMING A YARN RESERVE ON A CROSS-WOUND BOBBIN

[75] Inventors: Hans-Werner Schwalm, Mönchengladbach; Maximilian Preutenborbeck, Aachen; Johannes Thomalla, Mönchengladbach, all of Germany

[73] Assignee: W. Schlafhorst AG & Co., Moenchengladbach, Germany

[21] Appl. No.: 242,028

[22] Filed: May 12, 1994

Related U.S. Application Data

[63] Continuation of Ser. No. 887,224, May 18, 1992, abandoned, which is a continuation of Ser. No. 653,891, Feb. 11, 1991, abandoned.

[30] Foreign Application Priority Data

Feb. 10, 1990 [DE] Germany ..... 40 04 028.3

[51] Int. Cl.[6] ..... D01H 9/14; B65H 54/22; B65H 67/08

[52] U.S. Cl. ..... 57/278; 242/18 EW; 242/35.6 E

[58] Field of Search ..... 57/266, 276, 278, 304, 57/261, 305; 242/18 EW, 35.6 E

[56] References Cited

U.S. PATENT DOCUMENTS

| | | | |
|---|---|---|---|
| 3,198,446 | 8/1965 | Furst et al. | 57/305 X |
| 3,203,634 | 8/1965 | Furst | 57/305 X |
| 3,241,234 | 3/1966 | Kiefer et al. | 57/305 X |
| 3,728,550 | 4/1973 | Cleland, Jr. et al. | 242/35.6 E X |
| 3,866,848 | 2/1975 | Abbott | 242/35.6 E |
| 4,576,340 | 3/1986 | Aretz et al. | 242/35.6 E X |
| 4,630,782 | 12/1986 | Rohner | 242/18 EW |
| 4,724,665 | 2/1988 | Raasch et al. | 242/35.6 E X |
| 4,736,898 | 4/1988 | Raasch et al. | 242/18 EW |
| 4,878,344 | 11/1989 | Kiel | 242/35.6 E X |
| 4,891,933 | 1/1990 | Raasch | 242/18 EW X |
| 4,909,451 | 3/1990 | Kuepper et al. | 242/18 EW |
| 4,911,371 | 3/1990 | Mista | 242/35.6 E |
| 4,921,179 | 5/1990 | Surkamp et al. | 242/18 R |
| 5,104,052 | 4/1992 | Wey et al. | 242/18 EW |
| 5,106,027 | 4/1992 | Wirtz et al. | 242/18 EW X |

FOREIGN PATENT DOCUMENTS

| | | | |
|---|---|---|---|
| 1760243 | 12/1971 | Germany . | |
| 2305260 | 2/1973 | Germany | 242/18 EW |
| 2531044 | 1/1977 | Germany . | |
| 1245770 | 9/1971 | United Kingdom . | |

*Primary Examiner*—Joseph J. Hail, III

*Attorney, Agent, or Firm*—Herbert L. Lerner; Laurence A. Greenberg

[57] ABSTRACT

A method for forming a yarn reserve on an end surface of a cross-wound bobbin or cheese disposed on a bobbin tube includes predetermining a length of yarn for a yarn reserve. The yarn is unwound to the predetermined length from a cheese while temporarily storing the yarn in a reservoir. The presence of the yarn in the reservoir is detected with a sensor. The unwinding of the yarn is stopped and the rotational direction of the cheese is reversed to the given winding direction after attaining the predetermined length of the yarn. The yarn is then wound onto the one end of the bobbin tube while continuously holding the yarn taut with a restraining force of the reservoir. An apparatus for changing cheeses on a machine that produces cheeses and for forming a yarn reserve on an end surface of a cheese disposed on a bobbin tube includes a drive mechanism for unwinding a predetermined length of a yarn from a cheese. A reservoir receives and stores the yarn from the cheese. A yarn guide positions the yarn in the vicinity of and deposits the yarn on one of the ends of the bobbin tube. At least one sensor is disposed in at least one of the yarn guide and the reservoir for detecting the received yarn. A control device is connected to the at least one sensor for controlling the drive mechanism.

17 Claims, 5 Drawing Sheets

METHOD AND APPARATUS FOR FORMING A YARN RESERVE ON A CROSS-WOUND BOBBIN

CROSS-REFERENCE TO RELATED APPLICATION

This is a file-wrapper continuation of application Ser. No. 07/887,224, filed May 18, 1992 now abandoned, which was a continuation of application Ser. No. 07/653,891, filed Feb. 11, 1991, now abandoned.

SPECIFICATION

The invention relates to a method and apparatus for forming a yarn reserve on one of the ends of a cross-wound bobbin or cheese, preferably on the top end of the bobbin tube, by means of an apparatus for changing cheeses on a machine that produces such bobbins, in which the yarn is initially unwound from the cheese while rotating counter to the winding direction, and is subsequently wound onto the top end of the bobbin tube with the cheese rotating in the winding direction.

In order to further process and manipulate ready-wound cheeses, it is advantageous for the yarn end to be ready on one of the ends, preferably the top end, of the tube instead of having to first look on the surface of the ready-wound bobbin for the end of the yarn. A machine that produces cross-wound bobbins or cheeses is known from German Published, Non-Prosecuted Application DE-OS 36 02 574, corresponding to U.S. Pat. No. 4,736,898, in which a servicing unit that changes the ready-wound cheeses first applies a yarn reserve to one end of the bobbin before changing bobbins. Such a yarn reserve, for example on the top end of a bobbin tube, has a great advantage in further automatic handling of the cheeses, which is that the yarn can also be found on the same end.

In the known prior art, the yarn end is aspirated away from the bobbin surface, that is the peripheral surface, by a suction tube. The cheese which is lifted away from the winding roller is rotated counter to the winding direction. In that process, the end of the yarn is aspirated into the suction tube. After a predetermined time, the cheese is stopped and driven to rotate in the direction of bobbin winding. In that process, the bobbin pulls the yarn back out of the suction tube. Since there is a special yarn guide, the yarn slides into a guide channel and is carried past the package of the cheese to the end surface of the bobbin and there it is wound onto the top end of the bobbin tube.

Since the aspiration of the yarn is not monitored in the known apparatus, the yarn may not be aspirated at all, or it may be aspirated only after the bobbin has made several revolutions. The yarn end which is then aspirated may be too short to form a yarn reserve. On the other hand, if the beginning of the yarn is sought directly, a quantity of yarn can be aspirated into the suction tube which is so large that an excessively large yarn reserve is found, and in the most disadvantageous case it can slide off the top end of the bobbin tube and form trailing loops. This can happen particularly with bobbin tubes that have rounded edges on the top end.

It is accordingly an object of the invention to provide a method and apparatus for forming a yarn reserve on a cross-wound bobbin, which overcome the hereinafore-mentioned disadvantages of the heretofore-known methods and devices of this general type and which always form a yarn reserve having a yarn with an optimal length.

With the foregoing and other objects in view there is provided, in accordance with the invention, a method for forming a yarn reserve on an end surface of a cross-wound bobbin or cheese disposed on a bobbin tube having ends, with an apparatus for changing cheeses on a machine that produces cheeses, which comprises predetermining a length of yarn for a yarn reserve; unwinding the yarn to the predetermined length from a cheese rotating counter to a given winding direction while introducing the yarn into and temporarily storing the yarn in a reservoir; detecting the presence of the yarn in the reservoir with a sensor; stopping the unwinding of the yarn and reversing the rotational direction of the cheese to the given winding direction after attaining the predetermined length of the yarn; removing the yarn from the reservoir and positioning the yarn in the vicinity of one of the ends, preferably the top end, of the bobbin tube while reversing the rotational direction of the cheese to the given winding direction; and subsequently winding the yarn onto the one or top end of the bobbin tube while continuously holding the yarn taut with a restraining force of the reservoir.

With the objects of the invention in view there is also provided an apparatus for changing cross-wound bobbins or cheeses on a machine that produces cross-wound bobbins or cheeses and for forming a yarn reserve on an end surface of a cross-wound bobbin or cheese disposed on a bobbin tube having ends, comprising a drive mechanism for unwinding a predetermined length of a yarn from a cheese, means in the form of a reservoir for receiving and storing the yarn from the cheese, yarn guide means for positioning the yarn in the vicinity of and depositing the yarn on one of the ends, preferably the top end, of a bobbin tube, at least one sensor disposed in at least one of the yarn guide means and the reservoir for detecting the received yarn, and a control device connected to the at least one sensor for controlling the drive mechanism.

Therefore, according to the invention, the length of yarn made ready for forming the yarn reserve is not left to chance, but instead is predetermined. The yarn is unwound from the cheese in the predetermined length and temporarily stored in the reservoir. Since the cheese is driven constantly by a drive roller, the cheese furnishes a constant yarn quantity during each revolution of the drive roller. Accordingly, after the drive roller has been in operation for a specific time, a specific length of yarn will have been unwound from the cheese. However, due to the possibility of the above-described problems, this is not always assured. According to the invention, a sensor is therefore provided for ascertaining the presence of the yarn in the reservoir. Once the predetermined length of yarn in the reservoir has been attained, the unwinding is stopped, and the direction of rotation of the cheese is reversed to the winding direction. The yarn is positioned in the vicinity of the top end of the applicable bobbin tube, and the yarn can then be wound on the top end of the bobbin tube, while the yarn continues to be subjected to a restraining force in the reservoir and thus is kept taut.

In accordance with another feature of the invention, the reservoir may be a mechanical reservoir, such as for winding or loop pulling, or it may be a suction tube. A suction tube has the advantage of being able to be used not only for searching for, aspirating and storing the yarn end, but also for imposing a restraining force for tautening the yarn. This force is brought to bear by the flow of suction.

In accordance with a further feature of the invention, the unwinding of the yarn from the cheese can be stopped whenever the yarn has been detected by the sensor. It thus becomes unnecessary to specify a length of time for unwinding the yarn. Heretofore, such timing had to be based on the most disadvantageous case in which the yarn end was not discovered until after several rotations of the cheese. However, if the yarn end was detected directly, the predetermined safety time period had to be waited out unnecessarily, and an excessively long yarn end was stored.

In accordance with an added feature of the invention, after the yarn has been detected by the sensor, the yarn can continue to be unwound from the cheese and stored for a predeterminable period of time. The unwinding of the yarn is not stopped until this period has elapsed. Due to the cross-winding motion or traversing of the yarn during the winding, the yarn can assume such an disadvantageous position on the cheese that when the direction of rotation is changed, a length of yarn will first be rewound onto the cheese before it gets into the position from which it is wound onto the top end of the tube. For instance, this kind of disadvantageous yarn position arises whenever the yarn is located at the bottom end of the package and is supposed to move to the top end of the bobbin tube. If this disadvantageous yarn position is not taken into account, the yarn may be too short for the intended yarn reserve. Compensation for this disadvantageous yarn position is attained by means of the predeterminable period of time within which the bobbin continues to be unwound past the time when the sensor has already detected the yarn.

In accordance with an additional feature of the invention, the search for yarn on the cheese is ended whenever the yarn is not recorded by the sensor after a predeterminable period of time. A situation can arise in which the yarn end has become so stuck to the surface of the tube that it cannot be grasped. If it is not possible to loosen the yarn end, then the further method steps for forming a yarn reserve become unnecessary as well. In order to avoid these unnecessary method steps and thus gain time, the process is broken off whenever no yarn is ascertained by the sensor after a predetermined period of time. An error signal is issued and from this error signal, the operator can ascertain that the yarn end cannot be properly applied to the top end of the bobbin tube to form a yarn reserve.

In accordance with yet another feature of the invention, the the traversing motion of the yarn in the reservoir is largely suppressed during rotation of the cheese, and during the storage the yarn is positioned in the region of the end surface of the cheese on which the yarn reserve is to be formed.

In accordance with yet a further feature of the invention, the traversing motion of the yarn is prevented in a suction tube by means of a hook that is positioned at the mouth of the suction tube in such a way that the yarn is located only in the region of the end of the cheese on which the yarn is to be deposited. Restricting the traversing of the yarn in the suction tube permits rapid positioning of the yarn in the vicinity of the top end of the bobbin tube and thus rapid formation of the yarn reserve. It is also optimizes the yarn length of the yarn reserve.

If the same yarn length is always to be formed for the yarn reserve then, in accordance with yet an added feature of the invention, after yarn storage and positioning of the yarn in the vicinity of the top end of the bobbin tube have been ended, the yarn is cut to the predetermined length of the yarn reserve. An optimal time for cutting the yarn is defined, for instance in the case of storage in a suction tube, whenever the cheese has already been driven in the winding direction for a short time. Depending on the bobbin diameter, the yarn may already be positioned in the vicinity of the top end of the bobbin tube after less than half a rotation, because of the way in which the yarn is guided in the suction tube. However, a precondition for this is that the yarn is still detected by the sensor in the suction tube. With a view to the yarn length for the yarn reserves, this sensor should be capable of being positioned in the suction tube in such way that the yarn can still be detected once it has already been positioned in the vicinity of the top end of the bobbin tube.

The method can be even further improved if, in accordance with a concomitant feature of the invention, the length of the yarn in the region of the top end of the bobbin tube is monitored by a further sensor in this region, for example in the intake opening of the suction tube. The cheese, which is driven in the winding direction, can be stopped exactly at the moment that the yarn in this position is detected by the second sensor. If the yarn is furthermore also detected by the sensor in the suction tube, then the yarn can be cut by means of an adjustable cutter device in the region of this sensor to a yarn length determined to be optimal for the yarn reserve. The additional monitoring of the yarn length in the mouth of the suction tube, and the cutting of the yarn at the exactly predetermined yarn length enables the replicable formation of a precisely defined yarn reserve.

Other features which are considered as characteristic for the invention are set forth in the appended claims.

Although the invention is illustrated and described herein as embodied in a method and apparatus for forming a yarn reserve on a cross-wound bobbin, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
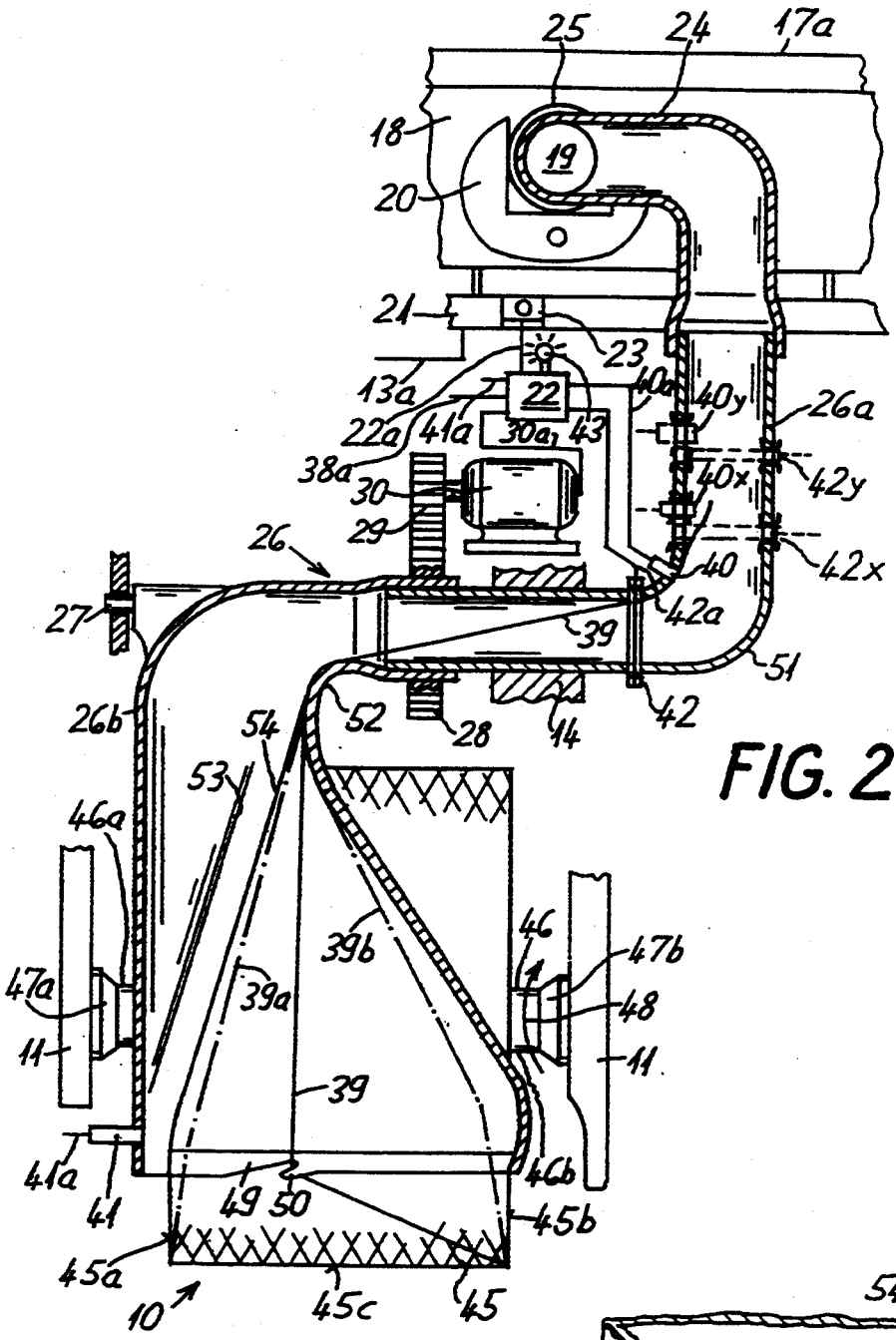
FIG. 2 is a fragmentary, longitudinal-section view of the suction tube for forming the yarn reserve during the aspiration of the yarn.
Figure 2A:
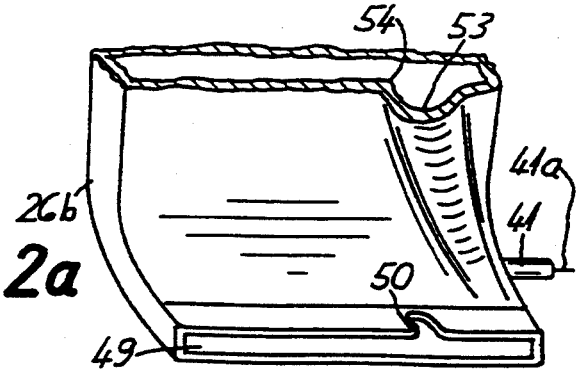
Figure 3:
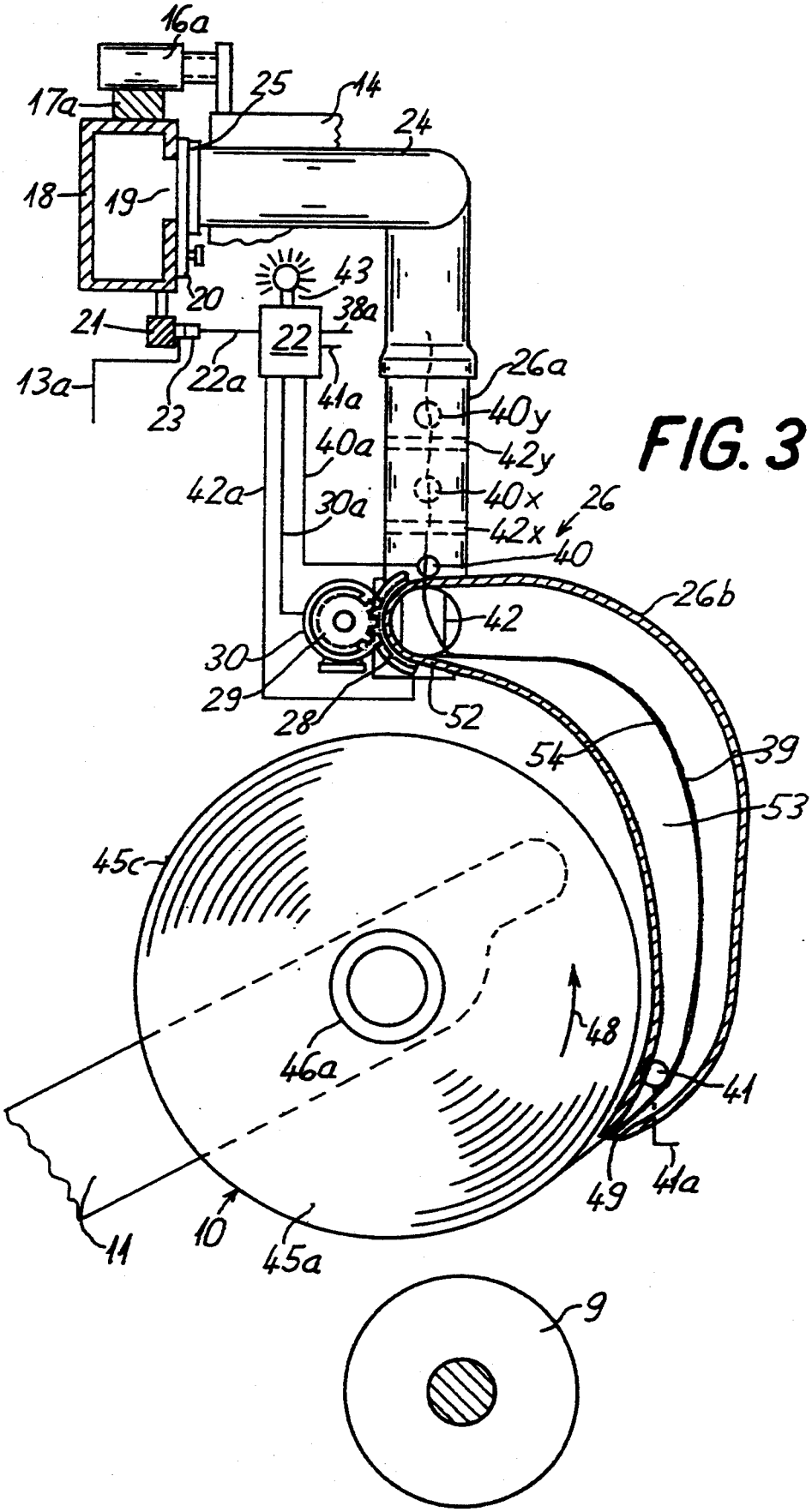
Figure 4:
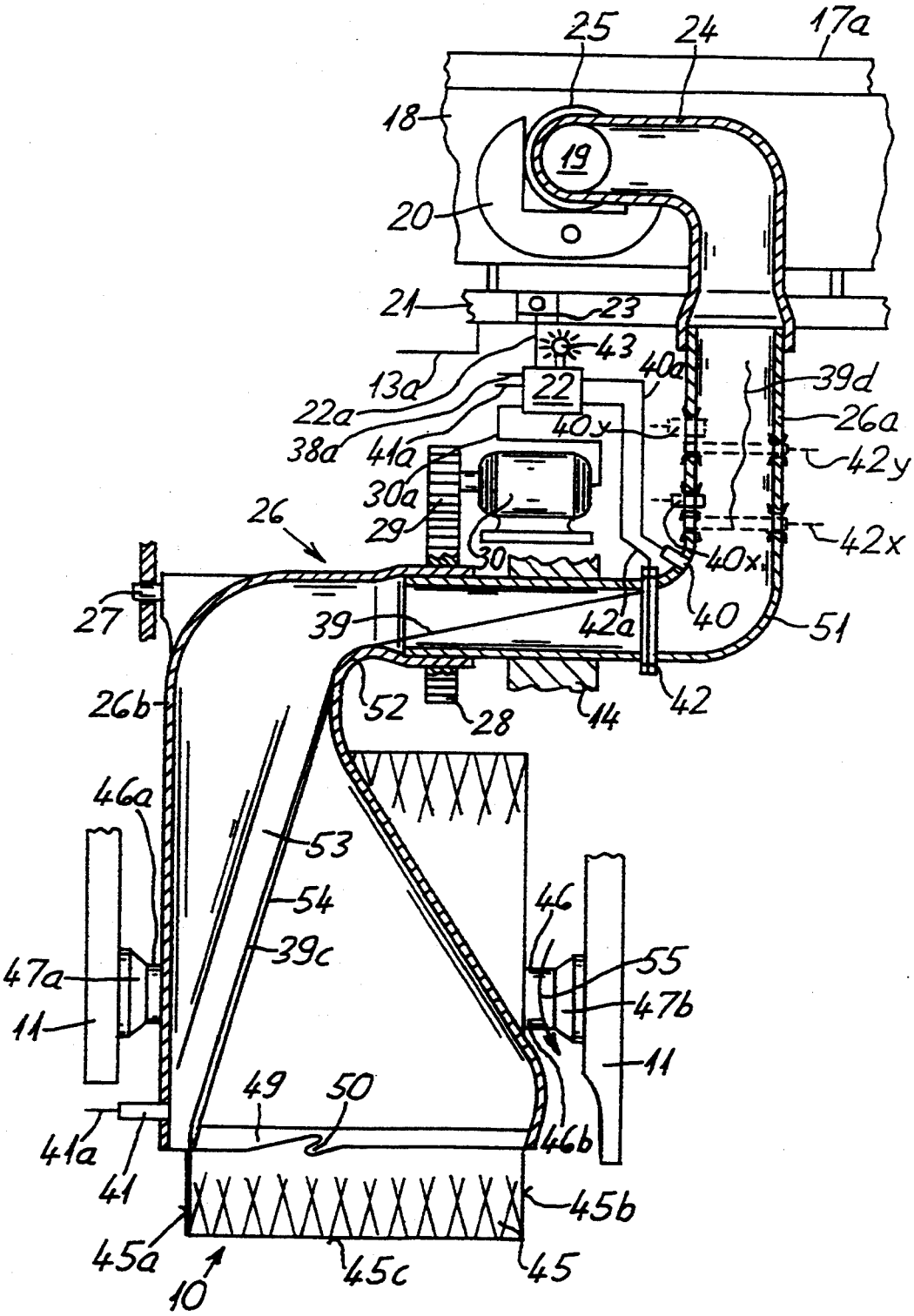
Figure 5:
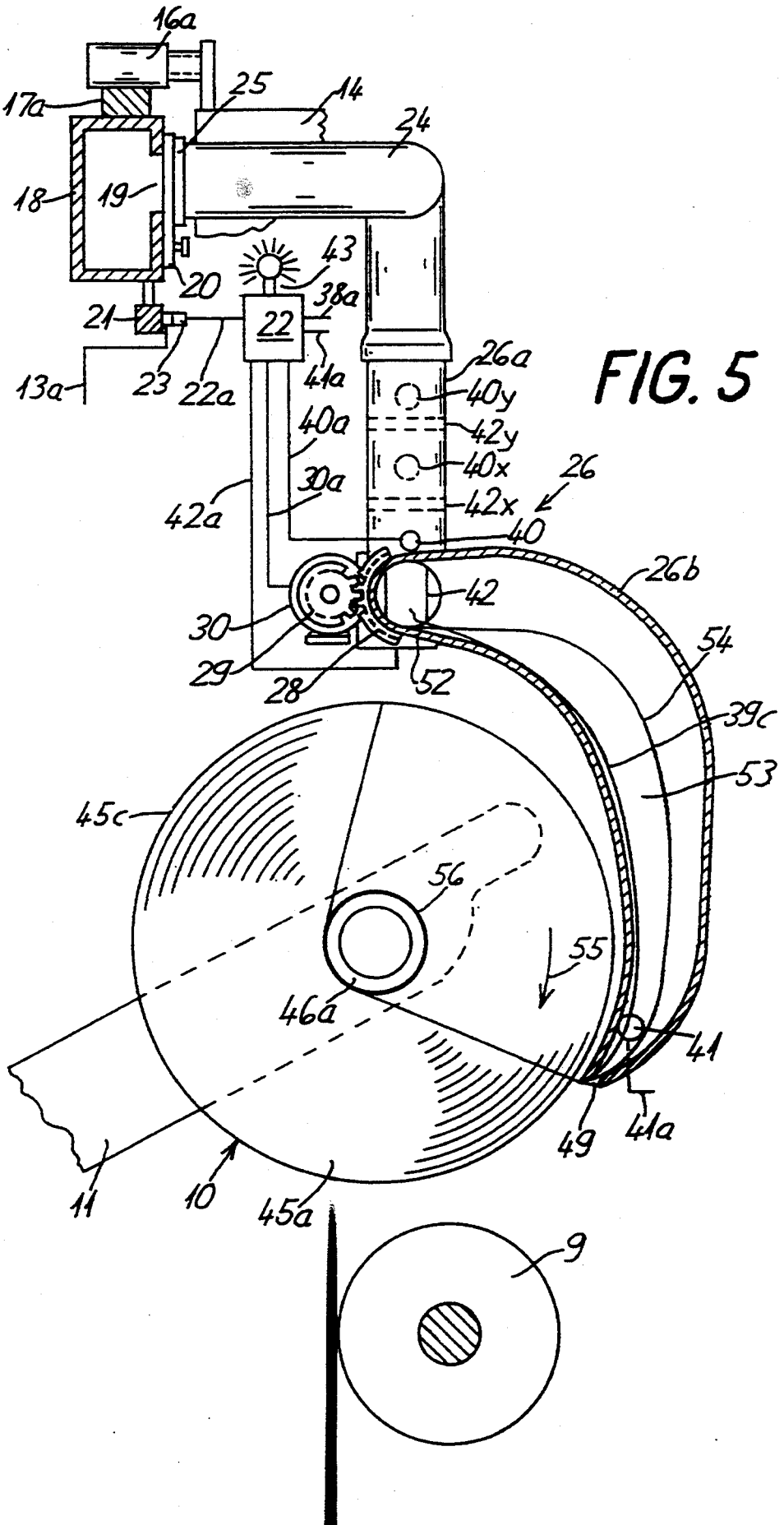

FIG. 2*a* is a fragmentary, front perspective view of the mouth of the suction tube;

FIG. 3 is a fragmentary, partly sectional, side-elevational view of the suction tube in the section of FIG. 2;

FIG. 4 is a view similar to FIG. 2 of the suction tube during the positioning of the yarn in the vicinity of the top end of the bobbin tube; and FIG. 5 is a view similar to FIG. 3 of the suction tube in the section, during the formation of the yarn reserve.

Figure 1:
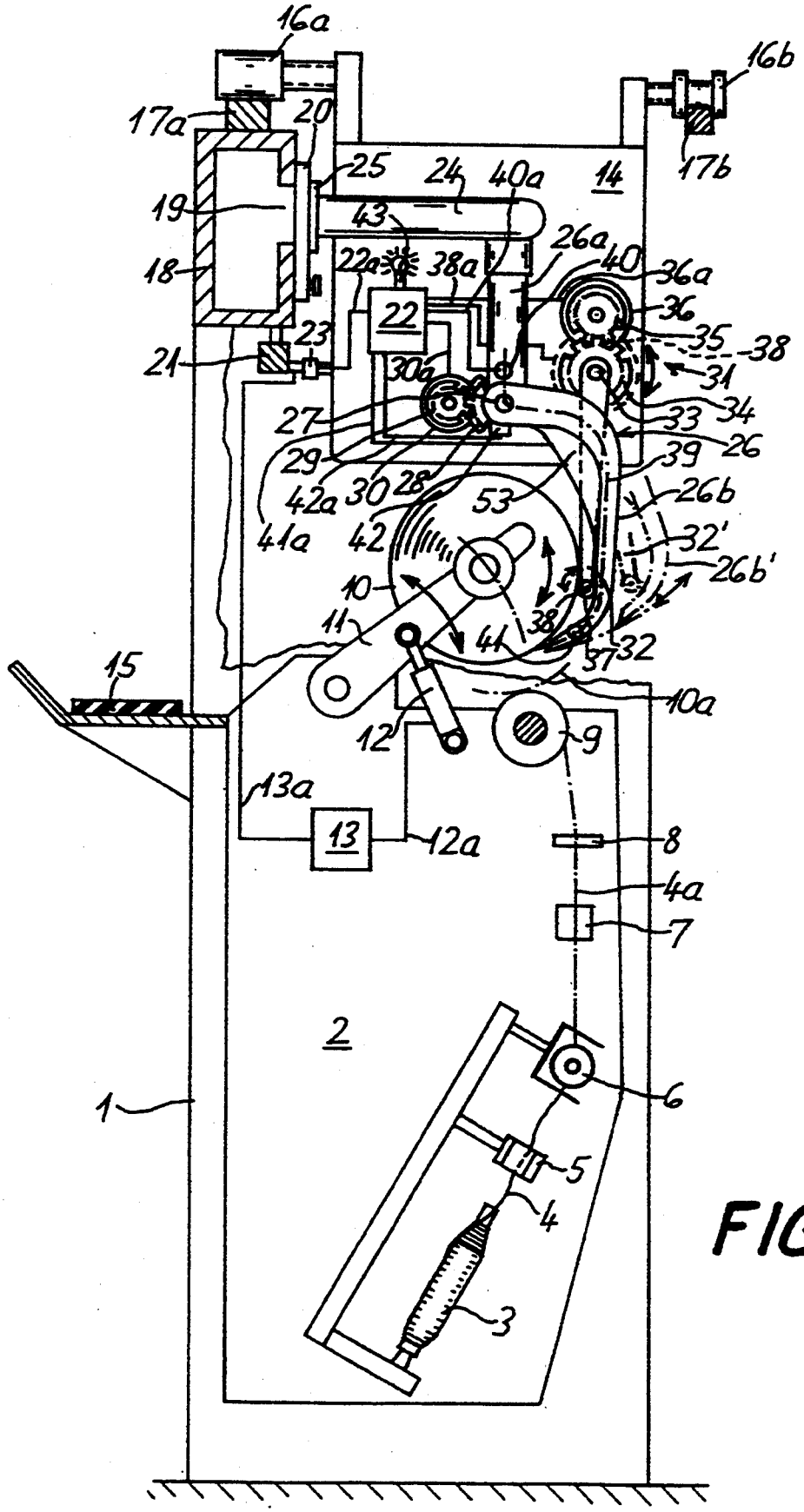
FIG. 1 is a diagrammatic, partly longitudinal-sectional and partly broken-away side-elevational view of a machine producing for cross-wound bobbins or cheeses, having an apparatus for changing cheeses and forming a yarn reserve, in which a suction tube serves as means for receiving and storing yarn.

Referring now to the figures of the drawing in detail and first, particularly, to FIG. 1 thereof, there is seen a bobbin winding machine 1 which is shown as a machine that produces cross-wound bobbins or cheeses. Instead of such a bobbin winder, other machines producing cheeses can be equipped with the apparatus according to the invention, with examples being open-end spinning machines or twisting machines.

Only one winding station 2 of the multiple winding stations in the machine is shown. Only those characteristics that contribute to a comprehension of the invention are shown and described. In the winding station 2, a spinning tube 3 is in an unwinding position. A yarn or thread 4 to be unwound passes through a balloon breaker 5 and a yarn tension 6. The remainder of the yarn course during a winding operation is marked by reference symbol 4*a*. The yarn passes through a yarn checker or tester and cleaner 7 and through a yarn guide baffle 8 to a grooved drum 9, which deposits the yarn in cross-wound layers on a cross-wound bobbin or cheese 10. In the present exemplary embodiment, the cheese has already been wound to completion and has therefore been lifted away from the grooved drum 9. The location of the cheese 10 during a winding operation is represented by a periphery 10*a*, shown in phantom. Since the cheese 10 has been lifted away from the grooved drum 9 and is in the so-called changing position, the yarn travel is interrupted, and the yarn ends in the yarn tensioner 6.

If a central computer or a winding station computer 13, for example, has detected a ready-wound cheese 10, then the computer issues a signal over a signal line 12*a* of a lifting device 12 to raise the creel 11 and thus lift the cheese 10 away from the grooved drum 9. The yarn travel is thus interrupted, and the yarn winds onto the surface of the cheese. A cheese changer 14 is called up over a signal line 13*a*. The cheese changer 14 is a servicing device that receives the fully wound cheeses from the creels and deposits them on a conveyor belt 15 extending along the machine. The full cheeses are replaced with empty bobbin tubes. This changing process is known in the art and has already been described in the aforementioned German Published, Non-Prosecuted Application DE-OS 36 02 574, corresponding to U.S. Pat. No. 4,736,898.

The cheese changer 14 travels on wheels 16*a* and 16*b* over rails 17*a* and 17*b* that extend above the winding stations along the bobbin winding machine. The cheese changer is therefore capable of moving from one winding station to another and there of replacing the full cheeses with empty bobbin tubes. The rail 17*a* is supported by a suction conduit 18, which is connected to a central negative pressure network of the bobbin winder. Located at each winding station is an opening 19 in the suction conduit, which is closed with a self-closing flap 20. The suction conduit 18 also includes a contact rail 21, to which the signal line 13*a* of the winding station computer 13 is connected. A control device 22 of the cheese changer 14 is connected over a signal line 22*a* to a wiper contact 23, which comes into communication with the winding station computer 13 through the contact rail 21 and the signal line 13*a*.

Once the cheese has been fully wound at the winding station 2 and raised to the changing position, the cheese changer 14 is called by the winding station computer 13. The cheese changer positions itself above the winding station. A suction connection tube 24 of a yarn reservoir or storage device 26 is guided with a flange 25 thereof along the suction conduit 18. Upon being positioned above the winding station, the flange 25 pushes the automatically closing flap 20 aside. As a result, the suction connection tube 24 communicates through the opening 19 with the suction conduit 18. A suction flow thus prevails in the suction connection tube 24 and simultaneously is present in a suction tube which serves as the yarn reservoir 26 and has a fixed portion 26*a* and a pivotable portion 26*b*.

Only those characteristics of the cheese changer 14 that contribute to a comprehension of the invention are shown. The function of a cheese changer is already known from the prior art, for instance from the aforementioned German Published, Non-Prosecuted Application DE-OS 36 02 574, corresponding to U.S. Pat. No. 4,736,898.

When the cheese changer moves to the winding stations, the pivotable portion 26*b* of the suction tube 26 is pivoted into a position 26*b*', so that it will not collide with the equipment at the winding stations nor with the bobbin in the changing position. It is not until the cheese changer 14 has come into position at the winding station 2, that the suction tube pivots out of the position 26*b*' into the position 26*b* flush against the surface of the cheese 10. In order to enable the pivoting motion, the suction tube portion 26*b* is pushed about the pivot joint 27 relative to the fixed portion 26*a* of the suction tube. The pivotable portion 26*b* of the suction tube has a toothed segment 28, which is engaged by a pinion 29 of a motor 30. The motor 30 is controlled by the control device 22 over a signal line 30*a* and receives a command from the control device 22 to pivot the suction tube. Other devices are also conceivable for performing the pivoting motion, such as a swivel gear that is actuated through a solenoid.

In order to permit a yarn reserve in accordance with the method of the invention to be formed, the cheese in the changing position must be driven. To this end, a cheese rotating apparatus 31 is provided. The cheese rotating apparatus includes a pivotable arm 32 with a friction wheel that is drivable and can be applied to the peripheral surface of the cheese. While the cheese changer 14 is moved along the bobbin winding machine, the arm 32 is pivoted into a position 32'. It is not until the cheese changer is positioned at the applicable winding station that the arm 32 is pivoted out of its position 32' in the direction toward the cheese 10, about a pivot joint 33. The arm 32 in the present exemplary embodiment has a toothed segment 34 in the pivot joint 33, and a pinion 35 engages the segment. The pinion 35 is driven by a motor 36, which communicates with the control device 22 over a signal line 36*a*. In order to perform swivel motions, the motor 36 is switched on and off by the control device 22 over the signal line 36*a*.

The lower end of the arm 32 has a friction wheel 37, which rests against the surface, that is the periphery, of the cheese 10. The friction wheel 37 is drivable in both rotational directions through a drive mechanism 38, which is hidden in the view of the drawing and is therefore shown in broken lines. The drive mechanism 38 is controlled by the control device 22 over a signal line 38*a*.

In order to search for the yarn, the cheese 10 is driven counter to the winding direction, or in other words counterclockwise, by the friction wheel 37. The suction tube portion 26*b*, which rests against the surface of the cheese over the entire width of the bobbin, then aspirates the yarn end resting loosely on the bobbin surface, and stores it until it is deposited on the top end of the bobbin tube. Yarn is aspirated until such time as the cheese 10 is driven counter to the winding direction. In FIG. 1, the course of a yarn 39 in the suction tube is represented in phantom. The presence of the yarn 39 in the suction tube 26 can be ascertained with the aid of a sensor 40 in the fixed portion 26*a* of the suction tube. If the yarn 39 is ascertained by the sensor 40, this is reported to the control device 22 over a signal line 40*a*. The location of the yarn 39 in the pivotable portion 26*b* of the suction tube can also be ascertained by a further sensor 41. The location of the yarn is then likewise reported to the control device 22 over a signal line 41*a*. A cutter device 42 in the fixed portion 26*a* of the suction tube can be actuated as a function of the location of the yarn 39, in order to shorten the yarn 39 to a length intended for the yarn reserve. The cutter device 42 is actuated by the control device 22 over a signal line 42*a*.

During the search for the yarn, a situation may arise in which the yarn end cannot be found on and aspirated from the peripheral surface of the cheese. This occurs, for instance, if the yarn end has been pushed into the surface of the bobbin. In order to avoid an unnecessary continuation of the process for yarn reserve formation, a time period can be predetermined through the control device, in which period the friction wheel 37 drives the cheese 10 counter to the winding direction. If after this period has elapsed no yarn is ascertained by the sensor 40, then the process is broken off by the control device 22 and an error report is issued. This error report can be indicated to the operator, for instance through an optical display by means of an error indicator 43, such as a signal light.

Both the formation of the yarn reserve and the structure of the apparatus for forming the yarn reserve will be described in detail below, while referring to the following figures of the drawing.

FIG. 2 shows the aspiration of the yarn which is unwound from the cheese, into the suction tube. For the sake of simplicity, those parts of the bobbin winder and of the cheese changer that do not contribute to a comprehension of the invention, have been omitted.

A yarn package 45 on the cheese 10 is made up of layers of yarn that are cross-wound one on top of the other on a bobbin tube 46. The bobbin tube 46 has a top end 46*a* and a bottom end 46*b*. In the case of conical bobbin tubes, the thinner end is called the top end. The top and bottom ends are rotatably fastened in tube holders 47*a* and 47*b* respectively located on the creel 11.

The pivotable portion 26*b* of the suction tube 26 is pivoted with a suction opening 49 thereof against the surface of the cheese, that is a peripheral surface 45*c*, in order to aspirate a certain yarn length for forming the yarn reserve on the top end of the bobbin tube. The suction connection tube 24 is positioned at the opening 19 of the suction conduit 18, so that a negative pressure prevails in the suction tube 26. If the yarn end is resting loosely on a surface 45*a* of the yarn package, then it is aspirated by the pivotable portion 26*b* of the suction tube whenever the bobbin 10 rotates counter to the winding direction, in the direction of an arrow 48. The cheese rotating apparatus has been omitted from this illustration, for the sake of simplicity. The pivotable portion 26*b* of the suction tube is rotatably supported on the fixed portion 26*a* of the suction tube, by means of a telescoping connection of the two tubes. A pivot joint 27 supports the pivotable portion 26*b* of the suction tube 26, which is bent at a right angle, and thus enables stable support of the tube. At the point at which the fixed suction tube portion and the pivotable suction tube portion are telescoped together, the toothed segment 28 is placed on the periphery of the pivotable suction tube portion 26*b*. The segment 28 meshes with the pinion 29. Toward the bobbin, the suction tube portion 26*b* widens in funnel-like fashion to a width such that the entire bobbin width and the top end of the bobbin tube are covered. The suction tube also flattens toward its suction opening 49 to such an extent that the suction opening is only in the form of a narrow gap. In order to provide a better comprehension of the structure of the suction tube and of the method of the invention, the suction tube has been shown in section over its entire length.

During the aspiration of the yarn, the yarn can wind back and forth across the entire width of the bobbin 10, to match the cross-wound deposition on the surface 45*c* of the yarn package. Extreme yarn positions 39*a* upon passage toward the left-hand end surface 45*a* of the cheese and 39*b* upon passage toward a right-hand end surface 45*b* of the cheese, form the legs of a cross-winding or traversing triangle, which intersect at a curvature 52 of the suction tube portion 26*b*. A catch hook 50 which is open toward the top end of the bobbin tube, is located in the suction opening 49, and is offset from the middle toward the top end 46*a* of the bobbin tube. Upon traversing of the yarn from its one extreme position 39*b* towards the other extreme position 39*a*, the yarn first slips past the hook 50. On the return of the yarn from the extreme position 39*a* due to its traversing motion, it is caught by the hook 50 and prevented from further traversing. The yarn is then in the position shown at reference numeral 39. When unwinding out of the vicinity of the end surface 45*b* of the yarn package, the yarn undergoes a sharp deflection. It can then traverse only between the hook 50 and the left extreme position 39*a*. The restriction of the traversing capability is advantageous for rapid deposition of the yarn on the top end of the bobbin tube and will be explained later herein.

As a result of the suction, the yarn follows the suction flow and takes the shortest path within the tube. Therefore, it presses against the inside of the curvature 52 in the pivotable suction tube portion 26*b* and against the inside of a curvature 51 in the fixed portion 26*a* of the suction tube 26. The sensor 40 is therefore provided on the inside of the curvature 51, for detecting the yarn. If the aspirated yarn 39 is detected by the sensor 40, the sensor reports this to the control device 22 through the signal line 40*a*. The drive mechanism 38 for rotating the cheese 10 receives a signal to continue to drive the cheese 10 for a predetermined period of time through the signal line 38*a*, so that a specific length of yarn can still be unwound from the cheese. Once this time has elapsed, it is assured that the yarn is occupying a position between the positions 39 and 39*a* and has been caught by the hook 50. A yarn length approximately between the hook 50 and the end of the yarn is thus available for winding up a yarn reserve.

The drive mechanism 38 of the cheese 10 is then stopped. The method could then proceed in a simplified fashion in such a way that the control device 22 would cause the drive mechanism 38 to drive the cheese 10 in the winding direction. Theoretically, this would wind up the yarn 39 at the level of the hook 50 at a point on the surface 45*c* of the yarn package. In order to permit the yarn to then reach the vicinity of the top end 46*a* of the bobbin tube, the suction tube portion 26*b* has a channel 53 in the form of yarn guide means, which begins in the curvature 52 and extends to the left-hand side of the opening 49 or in other words toward the top end 46a of the bobbin tube. The wall of the suction tube is curved outward away from the observer and thus forms a steeply extending edge 54 of the channel 53 toward the traversing region of the yarn. If the yarn 39 continues to be wound onto the yarn package, then it departs from the compulsory guidance by the yarn layers on the surface of the yarn package that is dictated during unwinding, because the tensile strain causes it to seek the shortest path. The yarn slips over the edge 54 into the channel 53 and is guided toward the left-hand side of the suction opening 49, outside the periphery of the cheese.

FIG. 2a shows the suction opening 49 and part of the pivotable suction tube portion 26b. The suction tube is shown broken off behind the slight curvature that facilitates application against the yarn package. This broken edge clearly shows the course of the channel 53 and the edge 54. Due to the way in which the suction tube portion 26b is three-dimensionally constructed, the channel between the suction opening 49 and the curvature 52 is deeper, as can be seen in FIG. 1, and then becomes less deep again in the region of the curvature 52.

The sensor 41 which is installed at the end of the channel 53, in the vicinity of the suction opening 49, detects the position of the yarn in the channel and reports this position to the control device 22 over its signal line 41a.

In FIG. 2, even more characteristics are shown that contribute to a comprehension of the invention. The cutter device 42 is used in the fixed portion 26a of the suction tube, upstream of the sensor 40 as viewed in the suction direction. The cutter device 42 is controlled by the control device 22 through the signal line 42a. With the cutter device 42, it is possible to cut the yarn to an exact length for forming a yarn reserve.

In order to enable adaptation of the yarn length for a yarn reserve, for example on the top of the tube or on the yarn package, as a function of the yarn parameters or other criteria, it may be advantageous to be able to install the sensor for detecting the yarn and the cutter device at various points in the suction tube, in order to meet the aforementioned criteria. To this end, locations 40x and 40y are provided in the fixed portion 26a of the suction tube. These are locations at which the sensor for detecting the yarn can be installed. Due to the variable distance from the suction opening 49, different lengths of the aspirated yarn can be set to form the particular yarn reserve which is intended.

Possible installation points 42x and 42y are provided for the cutter device 42 as well in order to shorten the yarn to the desired length in accordance with the aforementioned criteria.

In the aforementioned exemplary embodiment, only two further possible installation points for the sensor and the cutter device are provided. Exemplary embodiments are also conceivable in which more installation locations are provided, or in which the sensor and the cutter device are disposed in such a way that they are continuously displaceable inside the suction tube.

In FIG. 3, the location of the suction nozzle 26 relative to the cheese 10 and the yarn course during the aspiration phase are shown. To this end, the pivotable portion 26b of the suction nozzle is shown in section. The course of the channel 53 can be seen clearly. In FIG. 3, the yarn is not yet located in the channel but rather is in the funnel-like portion of the suction tube and traverses within the extreme positions 39a and 39b shown in FIG. 2.

FIG. 4 shows the instant at which the yarn in the suction tube is positioned in the vicinity of the top end of the bobbin tube and is to be wound onto this top end. The cheese 10 has already been rotated in the winding direction indicated by an arrow 55, by the cheese rotating apparatus 31, which is not shown in in FIG. 4. In this process the bobbin seeks to rewind the yarn onto the surface 45c of the yarn package 45. The yarn continues to be exposed to the suction in the suction tube and is thereby kept taut. The tension exerted upon the yarn 39 during winding causes it to slide in the curvature 52 across the edge 54 into the channel 53. The yarn seeks to take the shortest path inside the pivotable suction tube portion 26b. The channel is constructed in such a way that it ends at the suction opening 49 upstream of the end surface 45a of the yarn package 45. Accordingly, the yarn can no longer be wound onto the surface 45c of the yarn package but instead it slips off the yarn package laterally at the end surface 45a.

At the moment when the yarn drops into the channel 53 and assumes a position 39c, it is detected by the sensor 41 at the suction opening 49 at the end of the channel 53. The sensor reports this detection over its signal line 41a to the control device 22, which thereupon first stops the cheese rotating apparatus 31. At the same time, the sensor 40 must also detect the yarn in the fixed portion 26a of the suction tube. If that is the case, then the cutter device 42 is actuated by the control device 22 through the signal line 42a. If not, an error indication is made, for example by means of the signal light 43. A yarn remainder 39d is removed by suction as waste through the suction conduit 18. If the yarn has assumed the position 39c, then it is assured that after the yarn is cut by the cutting device, there will always be the same yarn length available for forming the yarn reserve on the top end of the bobbin tube.

Once the yarn has been shortened to the intended length, the cheese 10 is driven onward in the winding direction 55 by the cheese rotating apparatus 31. The yarn that has slipped downward at the end surface 45a of the yarn package is compulsorily wound onto the top end 46a of the bobbin tube. This sequence of the method is shown in FIG. 5, which is a view corresponding to FIG. 1.

In the suction tube portion 26b which is shown in section, the location of the yarn 39c in the channel 53 can be readily seen. It can also be seen how the yarn has slipped away from the surface 45c of the yarn package along the end surface 45a and has become wrapped around the top end 46a of the bobbin tube. For the sake of a better explanation of this process, the left-hand creel 11 and its tube holder 47a have been omitted. While the cheese 10 rotates in the direction of the arrow 55, the yarn 39c is pulled out of the suction tube portion 26b and forms a yarn reserve or top winding 56.

Once the yarn has been pulled all the way out of the suction tube portion 26b, this is detected by the sensor 41 and reported to the control device 22 through the signal line 41a. After a predeterminable delay period, which assures that the yarn end is wound completely onto the top end of the bobbin tube, the control device 22 issues a signal to the cheese rotating apparatus 31 to stop the drive of the cheese. The arm 32 of the cheese rotating apparatus 31 and the pivotable portion 26b of the suction tube 26 are pivoted away from the cheese into the respective positions 32' and 26b'. The cheese is then provided with a yarn reserve on the top end of the bobbin tube, which is known as a top winding. This facilitates further handling in subsequent processing steps. The cheese is thereupon changed in the manner already known from the prior art.

We claim:

1. A method for forming a yarn reserve on an end surface of a cross-wound bobbin or cheese disposed on a bobbin tube having ends, which comprises predetermining a length of yarn for a yarn reserve; disengaging a cheese from a grooved drum after the cheese has been wound to completion and moving a suction tube to the surface of the cheese while rotatably supporting the bobbin tube on a creel; searching for a yarn end on the cheese with suction in the suction tube; rotating the bobbin tube on the creel for rotating the cheese counter to a given winding direction and simultaneously unwinding the yarn only to the predetermined length from the rotating cheese without cutting the yarn while aspirating the yarn into the suction tube and temporarily storing the predetermined length of yarn therein; detecting the presence of the yarn in the suction tube with a sensor disposed inside the suction tube; stopping the unwinding of the yarn and reversing the rotational direction of the cheese to the given winding direction after the unwound yarn has attained the predetermined length in the suction tube; removing the unwound yarn from the suction tube and positioning, with a yarn guide channel formed in the suction tube, the unwound yarn in the vicinity of one of the ends of the bobbin tube while reversing the rotational direction of the cheese to the given winding direction; and subsequently forming the yarn reserve by winding the unwound yarn onto the one end of the bobbin tube while continuously holding the yarn taut with the suction in the suction tube acting as a restraining force.

2. The method according to claim 1, which comprises positioning the yarn in the vicinity of and winding the yarn onto a top end of the bobbin tube.

3. The method according to claim 1, which comprises continuing unwinding of the yarn from the cheese and introduction of the yarn in the suction tube for a predetermined period of time after detection by the sensor, and stopping the unwinding of the yarn after the predetermined period of time has elapsed.

4. The method according to claim 1, which comprises ending the searching step if the yarn has not been detected by the sensor after a predetermined period of time.

5. The method according to claim 4, which comprises issuing an error signal if the yarn is not detected during the searching step.

6. The method according to claim 1, which comprises greatly suppressing a traversing motion of the yarn in the suction tube upon rotation of the bobbin, and guiding the yarn in the vicinity of an end surface of the cheese on which the yarn reserve is to be formed, during the yarn storing step.

7. The method according to claim 1, which comprises cutting the yarn to the predetermined length intended for the yarn reserve after ending the steps of storing the yarn in the suction tube and positioning the yarn in the vicinity of the one end of the bobbin tube.

8. The method according to claim 1, which comprises detecting the positioning of the yarn in the vicinity of the one end of the bobbin tube by a sensor in the vicinity of the one end of the bobbin tube during the positioning step.

9. In an apparatus for changing cross-wound bobbins or cheeses on a machine that produces cross-wound bobbins or cheeses, an apparatus for forming a yarn reserve on an end surface of a cross-wound bobbin or cheese disposed on a bobbin tube having ends, comprising a drive mechanism for unwinding only a predetermined length of a yarn from a cheese without cutting the yarn while the cheese is rotatably supported on a creel, means in the form of a suction tube mounted displaceably relative to said drive mechanism for receiving and storing the unwound yarn from the cheese, means for displaceably mounting the suction tube relative to said drive mechanism, yarn guide means operatively associated with said suction tube for positioning the unwound yarn in the vicinity of and depositing the yarn on one of the ends of a bobbin tube, at least one sensor disposed in at least one of said yarn guide means and said suction tube, said sensor forming means for detecting and measuring the predetermined length of the yarn received in said suction tube, and a control device connected to said at least one sensor for controlling said drive mechanism.

10. The apparatus according to claim 9, wherein said suction tube has a given aspiration direction, and said at least one sensor is disposed in at least one of a plurality of locations in said suction tube as viewed along said given aspiration direction, for forming yarn reserves with yarns of different lengths.

11. The apparatus according to claim 9, wherein said suction tube has a suction opening formed therein, and including an additional sensor disposed in the vicinity of said suction opening for detecting the position of the yarn in the vicinity of the one end of the bobbin tube for transfer of the yarn to the one end of the bobbin tube.

12. The apparatus according to claim 11, including a cheese changer having a cheese rotating apparatus connected to said control device for driving the cheese, said control device being connected to said additional sensor as well as to said at least one sensor for controlling said cheese rotating apparatus.

13. The apparatus according to claim 11, including at least one hook disposed at said suction opening in said suction tube for largely suppressing a traversing motion of the yarn in said suction tube.

14. The apparatus according to claim 9, including a cutter device disposed in said suction tube.

15. The apparatus according to claim 14, wherein said cutter device is disposed in a given location and said location is adjustable according to the length of the aspirated yarn of the yarn reserve to be formed.

16. The apparatus according to claim 9, wherein said drive mechanism rotates the cheese counter to a given winding direction for unwinding the predetermined length of a yarn from the cheese, and said drive mechanism rotates the cheese in said given winding direction for winding the yarn onto the one end of the bobbin tube.

17. The apparatus according to claim 9, wherein said yarn guide means are in the form of a channel formed in a wall of said suction tube, said channel extending along a direction in which the yarn is received in said suction tube from inside said suction tube to a side of a suction opening of said suction tube for receiving and guiding the yarn to one of the ends of the bobbin tube.

* * * * *